US005433538A

United States Patent [19]

Itoh et al.

[11] Patent Number: 5,433,538

[45] Date of Patent: Jul. 18, 1995

[54] WIRE GUIDE IN A WIRE DOT PRINT HEAD

[75] Inventors: Kiyoshi Itoh, Kanagawa; Yasutaka Yamanaka, Hyogo, both of Japan

[73] Assignee: Fujitsu Limited, Kanagawa, Japan

[21] Appl. No.: 88,514

[22] Filed: Jul. 7, 1993

[30] Foreign Application Priority Data

Jul. 27, 1992 [JP] Japan ..... 4-199594

[51] Int. Cl.[6] ..... B41J 2/265

[52] U.S. Cl. ..... 400/124.24; 101/93.05

[58] Field of Search ..... 400/124, 124 GT, 124.24; 101/93.05

[56] References Cited

U.S. PATENT DOCUMENTS

| | | | |
|---|---|---|---|
| 3,802,543 | 4/1974 | Howard | 400/124 |
| 3,907,092 | 9/1975 | Kwan et al. | 400/124 |
| 3,991,871 | 11/1976 | McIntosh, Sr. | 400/124 |
| 4,081,067 | 3/1978 | Schrag et al. | 400/124 |
| 4,154,541 | 5/1979 | Tsukada | 400/124 |
| 4,461,984 | 7/1984 | Whitaker et al. | 400/323 |
| 4,552,064 | 11/1985 | Sanders, Jr. et al. | 101/93.05 |
| 4,634,302 | 1/1987 | West et al. | 400/124.24 |

FOREIGN PATENT DOCUMENTS

| | | | |
|---|---|---|---|
| 253189 | 1/1988 | European Pat. Off. | 400/124 |
| 2702654 | 7/1978 | Germany | 400/124 |
| 123674 | 7/1984 | Japan | 400/124 |
| 122759 | 6/1987 | Japan | 400/124 |
| 267152 | 11/1987 | Japan | 400/124 |
| 62-278054 | 12/1987 | Japan | 400/124 |
| 2530 | 1/1990 | Japan | 400/124 |
| 428562 | 1/1992 | Japan | 400/124 |

*Primary Examiner*—David A. Wiecking

[57] ABSTRACT

A wire dot print head having long thin print wires capable of axially advancing and withdrawing with respect to a print surface, and a wire driving device connected to the proximal end of each of the print wires so as to drive the print wire to advance and withdraw axially. The wire dot print head includes a distal end guide for guiding the distal end portions of the print wires so as to prevent them from shifting diametrically, and an intermediate guide for guiding portions of the print wires which are at an antinode in the secondary natural vibration mode of the print wires so as to prevent the print wires from oscillating diametrically.

13 Claims, 13 Drawing Sheets

WIRE GUIDE IN A WIRE DOT PRINT HEAD

BACKGROUND OF THE INVENTION

1. Field of the Invention

The present invention relates to a wire dot print head in which print wires are driven to advance and withdraw to thereby perform impact dot printing.

Wire dot print heads are capable of high-speed printing and superior in cost performance and hence widely used in serial printers, line printers, etc.

2. Description of the Related Art

In a typical wire dot print head, a distal end guide is provided to guide the distal end of each print wire, which is driven to advance and withdraw, so as to prevent it from deviating from a predetermined position.

However, as the length of the print wires increases, the above-described wire guide structure becomes unsatisfactory. That is, as each print wire is driven to advance and withdraw, the print wire vibrates with nodes at the proximal end fixing portion and the distal end guide portion. The amplitude of the vibration increases as the print wire lengthens, so that the print wire is likely to break in the vicinity of the distal end guide due to fatigue.

Therefore, it has been conventional practice to provide an intermediate guide for guiding the print wire so as to prevent it from oscillating in the diametrical direction at a position corresponding to the antinode (loop) in the primary natural vibration mode of the print wire, that is, a position in the middle between the proximal end fixing portion and the distal end guide portion.

If the intermediate guide is thick, it may interfere with the movement of the print wires, which are driven to advance and withdraw while warping to a certain extent. Therefore, the intermediate guide is formed by disposing two thin plate members at a spacing, which are provided with guide holes through which the print wires pass loosely. If the intermediate guide comprises a single plate member, the pressure that is applied by the print wires concentrates thereon. Accordingly, the intermediate guide is likely to be damaged or deformed. If three or more plate members are used, one or more of them fail to contact a print wire. Therefore, there is no sense in increasing the number of plate members more than two.

However, even if an intermediate guide is provided in the vicinity of the antinode in the primary natural vibration mode of the print wires to prevent oscillation thereof, as described above, the accident that a print wire is broken in the vicinity of the distal end guide portion has still occurred at a considerably high rate.

The present inventors have noticed that the above-described accident is caused by the secondary natural vibration of the print wires.

FIG. 21 shows distributions of bending stresses (C) generated in a print wire 9 in two cases: (A) where the print wire 9 vibrates in the primary natural vibration mode, and (B) where it vibrates in the secondary natural vibration mode.

As will be clear from the figure, for the same maximum amplitude, the stress that is generated in the print wire 9 in the vicinity of a distal end guide 3 in the secondary natural vibration mode is about 2.5 times larger than that in the primary natural vibration mode. Accordingly, even if the primary natural vibration is successfully suppressed, the print wire 9 is likely to break due to the stress generated by the secondary natural vibration.

Incidentally, the intermediate guide, which guides the intermediate portions of the print wires, is formed from a plastic material. However, since it is formed in a thin plate-like shape, the intermediate guide is readily warped. In addition, since the contact pressure of the print wires is high, the intermediate guide is likely to wear at a high rate. As the wear progresses, the guide holes enlarge, which makes the intermediate guide unable to function as a guide.

SUMMARY OF THE INVENTION

An object of the present invention is to provide a wire dot print head which is designed so that the print wires will not be broken by vibration, and the intermediate guide is durable for a long period of time without being damaged or deformed.

Other objects and advantages of the present invention will become apparent from the following detailed description of illustrated embodiments of the invention.

According to the present invention, there is provided a wire dot print head having long thin print wires capable of axially advancing and withdrawing with respect to a print surface, and a wire driving device connected to the proximal end of each of the print wires so as to drive the print wire to advance and withdraw axially. The wire dot print head includes a distal end guide for guiding the distal end portions of the print wires so as to prevent them from shifting diametrically, and an intermediate guide for guiding portions of the print wires which are in the vicinity of an antinode in the secondary natural vibration mode of the print wires so as to prevent the print wires from oscillating diametrically.

BRIEF DESCRIPTION OF THE DRAWINGS

The present invention may be more fully understood from the description of preferred embodiments of the invention set forth below, together with the accompanying drawings, in which.

DESCRIPTION OF THE PREFERRED EMBODIMENTS

Embodiments of the present invention will be described below with reference to the accompanying drawings.

Figure 1:
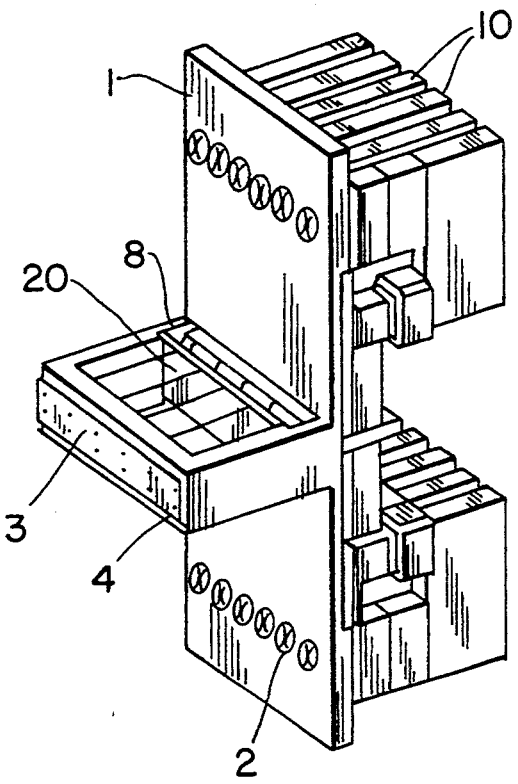
FIG. 1 is a perspective view of a print head in a first embodiment of the present invention.

FIG. 1 shows a first embodiment of the present invention, in which the present invention is applied to an electromagnetic release type print head. However, the present invention is not necessarily limited thereto but may be widely applied to print heads in which print wires are advanced and withdrawn to perform impact dot printing, e.g., the attraction type or piezoelectric type of print head.

This print head comprises a pair of upper and lower rows of 6 print elements 10 (i.e., a total of 12 print elements 10), which are secured to a frame 1 made of a nonmagnetic material by using screws 2.

A distal end guide 3 having 12 holes provided at predetermined positions is secured to the distal end of the frame 1. The distal ends of print wires 9, which are driven to advance and withdraw in the respective print elements 10, are slidably passed through the respective holes in the distal end guide 3.

It should be noted that each print wire 9 has a diameter of, for example, 0.2 mm, and a length of, for example, 30 mm. The distal end guide 3 is secured to the distal end of a nose portion 4 projecting forwardly from the frame 1.

Figure 2:
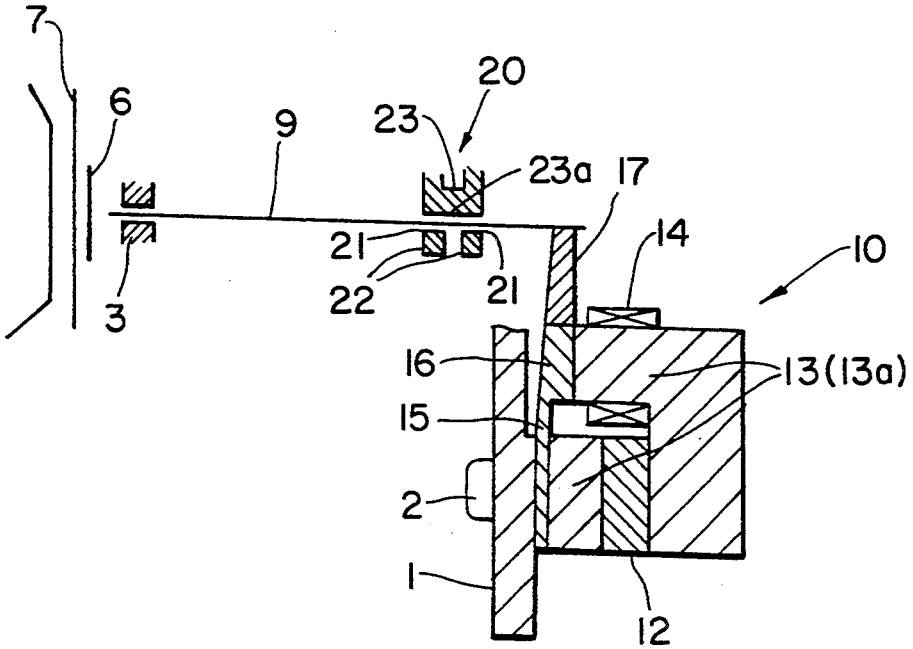
FIG. 2 is a sectional side view of a print element in the first embodiment of the present invention.
Figure 3:
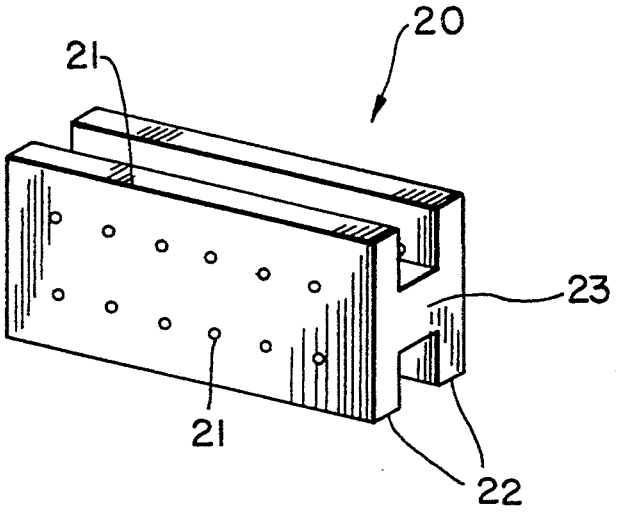
FIG. 3 is a perspective view of an intermediate guide in the first embodiment of the present invention.

FIG. 2 shows one print element 10, in which a yoke 13 for forming a magnetic circuit is disposed with a permanent magnet 12 sandwiched therein.

The distal end portion (iron core) 13*a* of the yoke 13 is wound with an electromagnetic coil 14 so that when energized, the coil 14 generates electromagnetic force in a direction in which the attractive force from the permanent magnet 12 is canceled.

A leaf spring 15 is sandwiched between the yoke 13 and the frame 1. The leaf spring 15 extends sidewardly, and an armature 16 made of a magnetic material is brazed to the distal end of the leaf spring 15 at a position where it faces the iron core 13*a*. The proximal end portion of a print wire 9 is secured to the distal end of the armature 16 through a beam 17.

In the natural condition, the leaf spring 15 lies substantially straight, providing a gap between the armature 16 and the iron core 13*a*. However, the magnetic flux produced by the permanent magnet 12 passes through the magnetic circuit. Therefore, in the stand-by state, the armature 16 is magnetically attracted to the iron core 13*a*, causing the leaf spring 15 to be elastically deformed. Thus, strain energy is stored in the leaf spring 15.

When current is passed through the electromagnetic coil 14 from a driver circuit (not shown) on the basis of a control signal from a print controller (not shown), the magnetic force of the permanent magnet 12 is canceled in the magnetic circuit. Accordingly, the armature 16 is moved away from the iron core 13*a* by the resilience of the leaf spring 15.

Consequently, the distal end of the print wire 9 moves, e.g., 0.5 mm, in a direction in which it projects from the distal end guide 3, and strikes a sheet of recording paper 7 through an ink ribbon 6, thereby effecting printing of one dot.

As shown in FIG. 2, an intermediate guide 20 for supporting an intermediate portion of the print wire 9 is disposed at a position which is 7 to 8 mm from the proximal end portion of the print wire 9 that is fixed to the beam 17, that is, in the vicinity of the first antinode in the secondary natural vibration mode of the print wire 9. Accordingly, the secondary natural vibration of the print wire 9 is suppressed, so that the bending stress generated in a portion of the print wire 9 that is guided by the distal end guide 3 decreases by a large margin.

According to an experiment, the print wire 9 was not broken even when printing was conducted 200,000,000 times, whereas it was broken when printing was conducted about 10,000,000 times in an arrangement where the intermediate guide 20 was disposed in the vicinity of the longitudinal center of the print wire 9 to suppress the primary natural vibration.

The intermediate guide 20 comprises a pair of thin plate members 22 which are connected together as one unit by a connecting member 23 with a spacing provided therebetween. Each plate member 22 is provided with guide holes 21 at predetermined positions. The guide holes 21 have a diameter of, for example, 0.5 mm, so that the print wires 9 are loosely passed therethrough. The whole intermediate guide 20 is formed from a plastic material of excellent slip properties by integral molding process. Accordingly, even if the plate members 22 are thin, the intermediate guide 20 is not readily deformed, and there is substantially no likelihood of the intermediate guide 20 being warped.

The connecting member 23 is connected to the central portions of the two plate members 22 so as not to cover the guide holes 21. Thus, the intermediate guide 20 has an H-shaped cross-sectional configuration.

Figure 4:
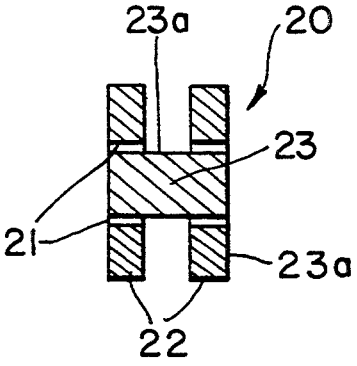
FIG. 4 is a sectional side view of the intermediate guide in the first embodiment of the present invention.

As shown in FIG. 4, each surface 23*a* of the connecting member 23 extends between the facing guide holes 21 substantially coplanarly with an imaginary line intersecting the diametrically innermost points on the peripheral surfaces of each pair of facing guide holes 21 (ideally, several hundredths of mm recessed from the imaginary line).

Accordingly, each print wire 9, which advances and withdraws through a pair of facing guide holes 21, contacts one surface 23*a* of the connecting member 23 in between the guide holes 21, as shown in FIG. 2. Thus, the area of contact is markedly large in comparison to an arrangement in which the print wire 9 contacts only the guide holes 21. Accordingly, the contact pressure is low, and wear of the contact portions is minimized.

It should be noted that each print wire 9 is guided by the intermediate guide 20 and the distal end guide 3 so as to be only slightly warped, and the connecting member 23 is disposed at a side toward which the print wire 9 is convexly warped. Accordingly, the print wire 9 surely contacts one surface 23*a* of the connecting member 23.

Figure 5:
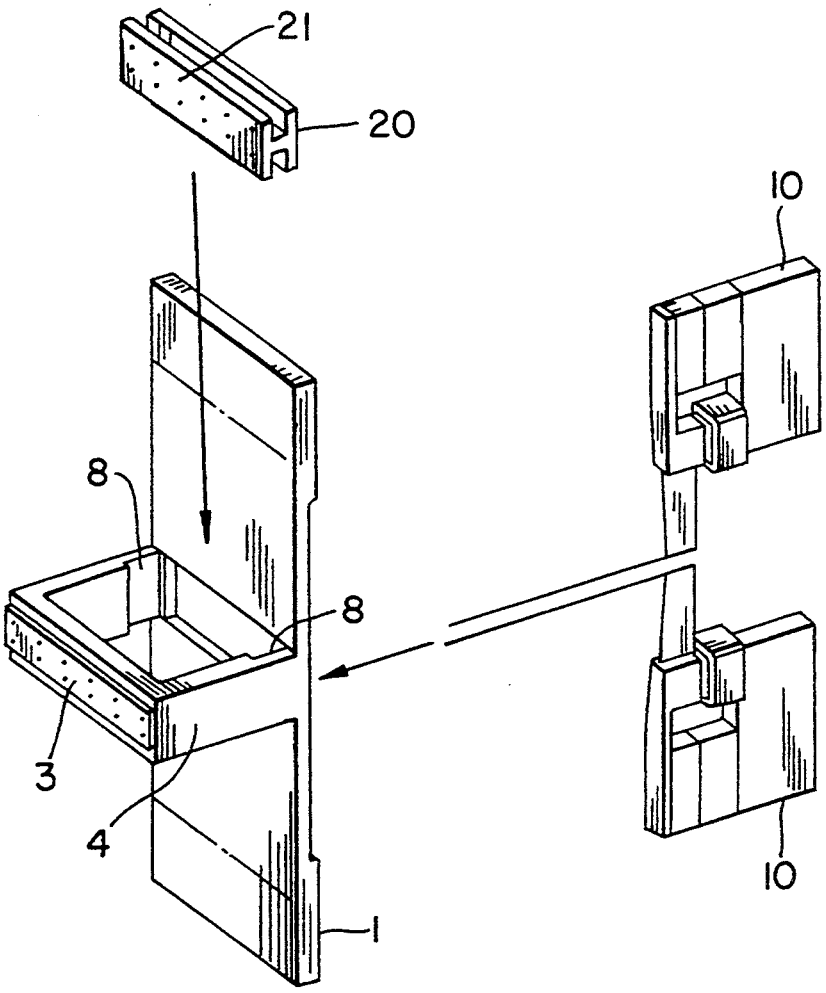
FIG. 5 is an exploded perspective view of the print head in the first embodiment of the present invention.

As shown in FIG. 5, the intermediate guide 20, arranged as described above, is loosely inserted into a groove 8 formed in the frame 1 and positioned in the longitudinal direction. Then, the print wires 9 are passed through the respective guide holes 21, thereby preventing the intermediate guide 20 from moving in the insertion direction. It should be noted that in FIG. 5 only a pair of upper and lower print elements 10 are illustrated.

Figure 6:
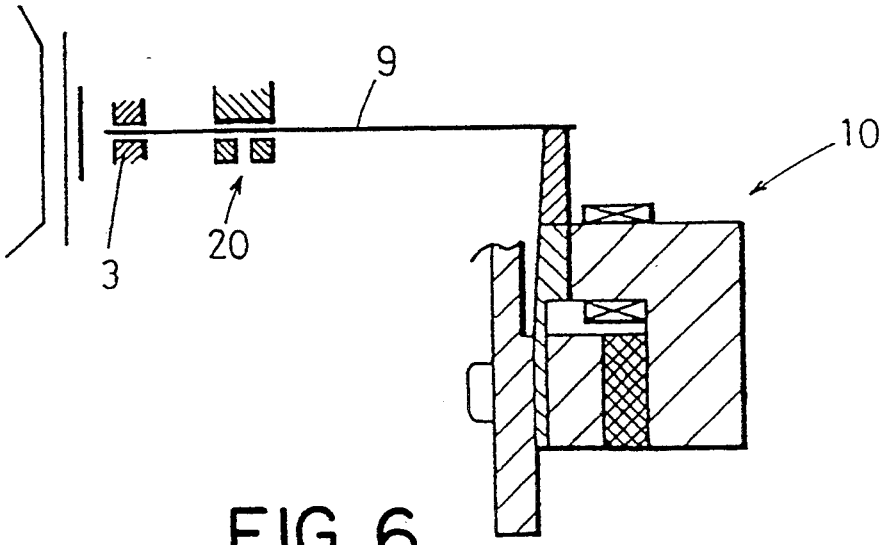
FIG. 6 is a sectional side view of a print element in a second embodiment of the present invention.
Figure 7:
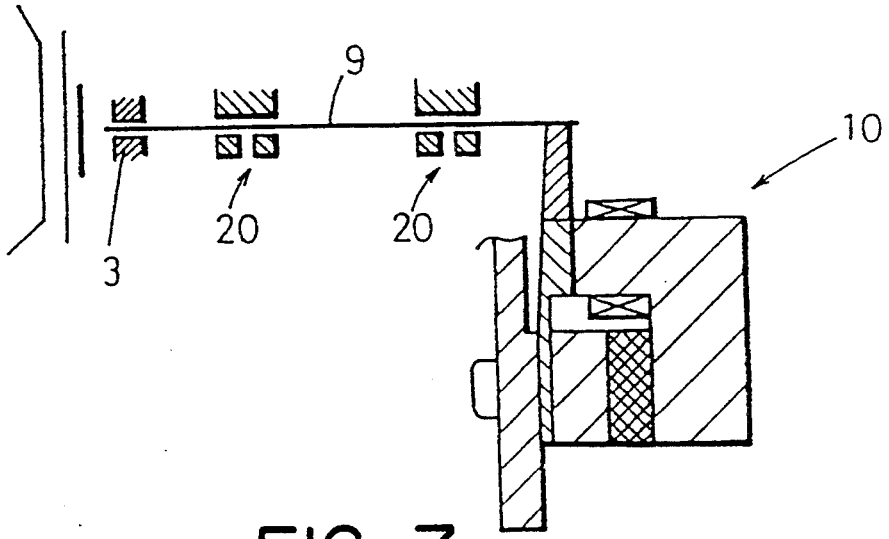
FIG. 7 is a sectional side view of a print element in a third embodiment of the present invention.

Although in the above-described embodiment the intermediate guide 20 is disposed at the first antinode in the secondary natural vibration mode of the print wires 9, it should be noted that the intermediate guide 20 may be disposed at the second antinode, i.e., a position which is 7 to 8 mm from the distal end guide 3, as in a second embodiment shown in FIG. 6. It is also possible to dispose the intermediate guide 20 at each of the first and second antinodes as in a third embodiment shown in FIG. 7. In either case, generation of secondary natural vibration of the print wires 9 is suppressed.

Figure 8:
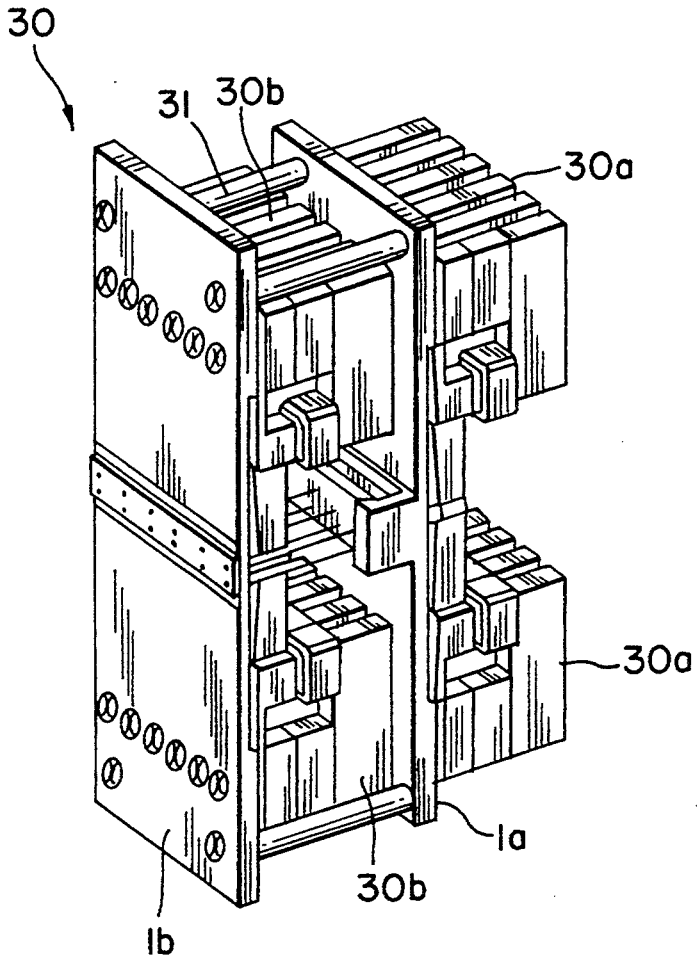
FIG. 8 is a perspective view of a print head module in a fourth embodiment of the present invention.
Figure 9:
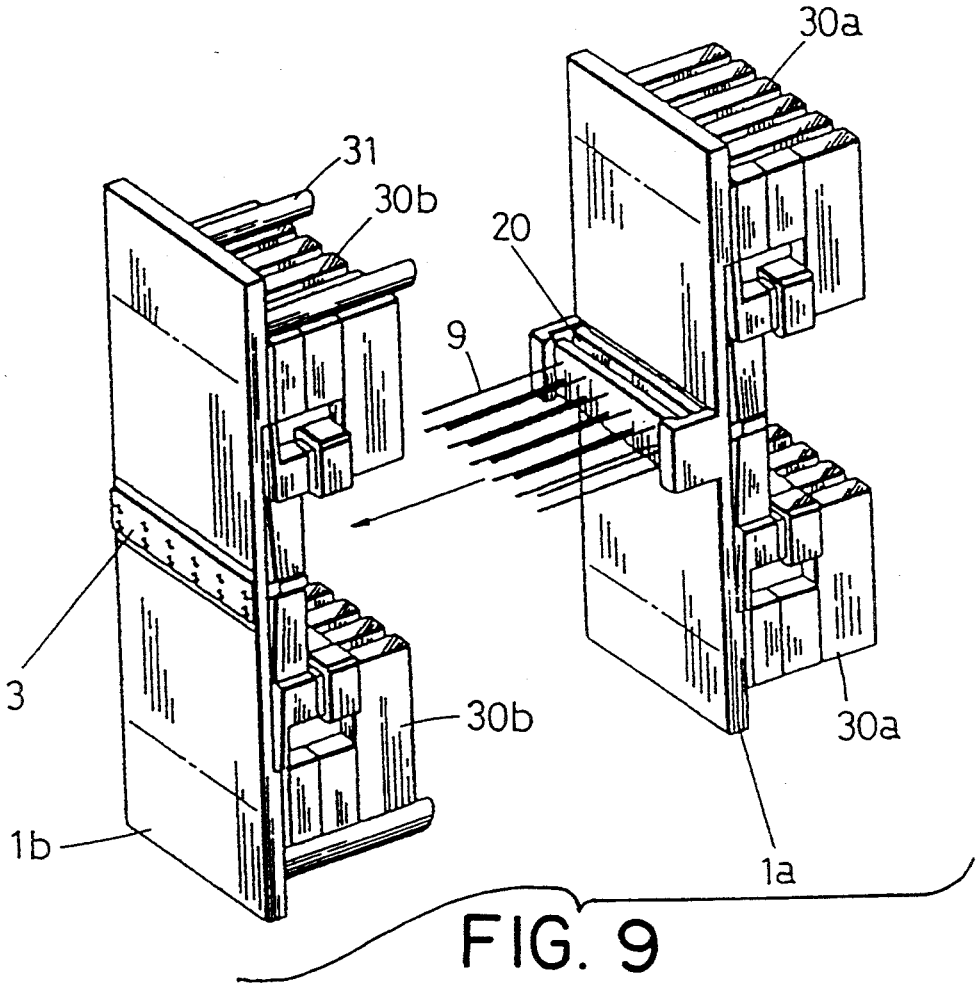
FIG. 9 is an exploded perspective view of a print head module in the fourth embodiment of the present invention.
Figure 10:
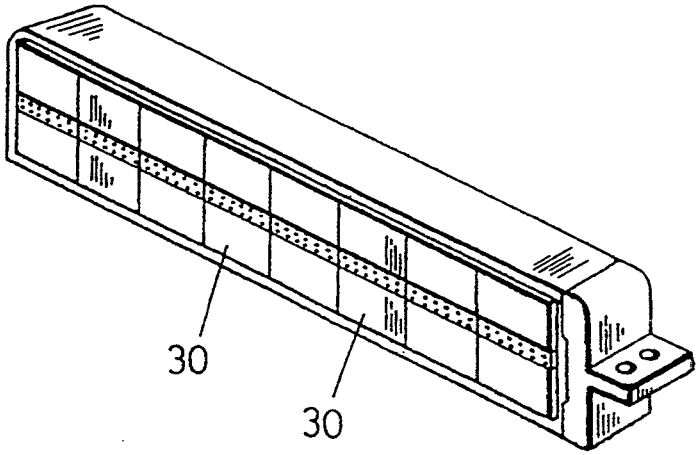
FIG. 10 is a perspective view of a print head unit in the fourth embodiment of the present invention.

FIGS. 8 to 10 show a fourth embodiment of the present invention, in which the wire dot print head of the present invention is applied to a print head of a line printer.

As shown in FIG. 8, a pair of print heads 30*a*, which are similar to the above-described first embodiment, are disposed at the upper and lower sides, respectively, in the rear stage, and a pair of print heads 30*b* having relatively short print wires are disposed at the upper and lower sides, respectively, in the front stage. Thus, one print head assembly 30 is formed.

As shown in FIG. 9, which illustrates the print head assembly 30 in a state where the front and rear stages are separate from each other, the print heads 30*b* in the front stage are secured to a frame 1*b*, while the print heads 30*a* in the rear stage are secured to a frame 1*a*, and the front frame 1*b* and the rear frame 1*a* are secured to each other as one unit by using screws through connecting rods 31.

In this embodiment, the intermediate guide 20 is provided only for the rear stage. The arrangement of the intermediate guide 20 is the same as in the first embodiment. The arrangement of the intermediate guide 20 may be the same as in the second or third embodiment. The print wires in the front stage are relatively short, and the amplitude of vibration thereof is relatively small. Therefore, it is unnecessary to provide an intermediate guide.

A print head unit of a line printer is formed by disposing a row of 8 (for example) print head assemblies 30 horizontally, as shown in FIG. 10. In this case, 192 dots can be simultaneously printed.

Figure 11:
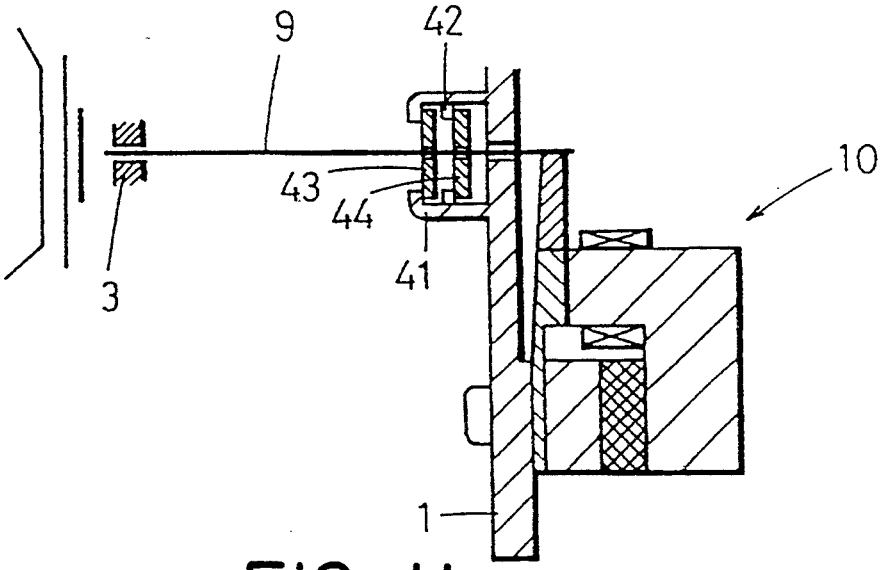
FIG. 11 is a sectional side view of a print element in a fifth embodiment of the present invention.
Figure 12:
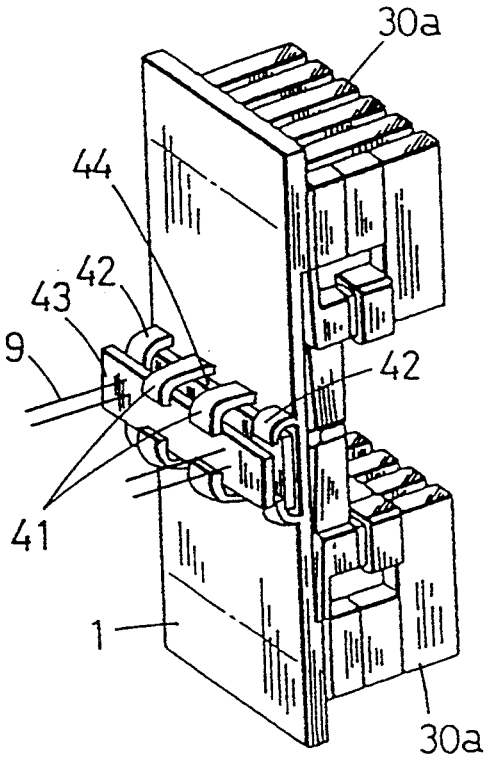
FIG. 12 is a perspective view of a print head in the fifth embodiment of the present invention.

FIGS. 11 and 12 show a fifth embodiment of the present invention, in which two intermediate guides 43 and 44, each formed of a thin plate, are supported at the upper and lower ends thereof by a plurality of L-shaped projections 41 and 42 projected from a frame 1 with a spacing between the two intermediate guides 43 and 44 and with some play in the intermediate guide supporting structure. Each print wire 9 extends through guide holes formed in the intermediate guides 43 and 44 at a portion thereof which is in the vicinity of the first antinode in the secondary natural vibration mode.

With this arrangement, since the L-shaped projections 41 and 42 can readily be formed together with the frame 1 as one unit by integral molding process, the production is easier than in the first embodiment, in which the nose portion 4 and the groove 8 are provided. Accordingly, the production cost can be lowered.

Further, the intermediate guides 43 and 44 are not fixed but disposed with some play with respect to the flame 1. Therefore, even if the intermediate guides 43 and 44 have some warp, they can move to where the intermediate guides 43 and 44 offer minimal resistance to the movement of the print wires 9. Accordingly, wear of the intermediate guides 43 and 44 can be minimized.

Figure 13:
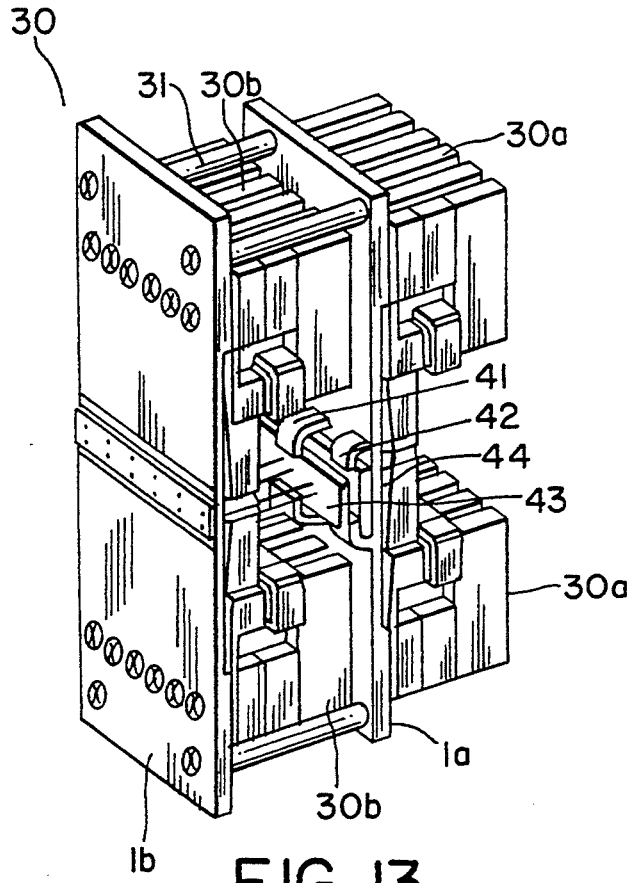
FIG. 13 is a perspective view of a print head module in the fifth embodiment of the present invention.

FIG. 13 shows a print head assembly 30 similar to that shown in FIG. 8, which is arranged by using the print head of the above-described fifth embodiment.

Figure 14:
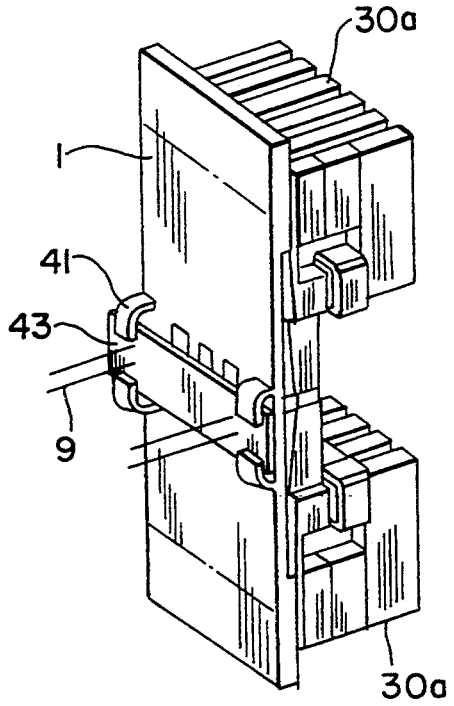
FIG. 14 is a perspective view of a print head in a sixth embodiment of the present invention.

FIG. 14 shows a sixth embodiment of the present invention, in which a single intermediate guide 43 comprising a thin plate is supported with some play by L-shaped projections 41 projected from a frame 1. Thus, a single intermediate guide 32 will suffice as long as there is no likelihood of the intermediate guide 43 being broken.

Figure 15:
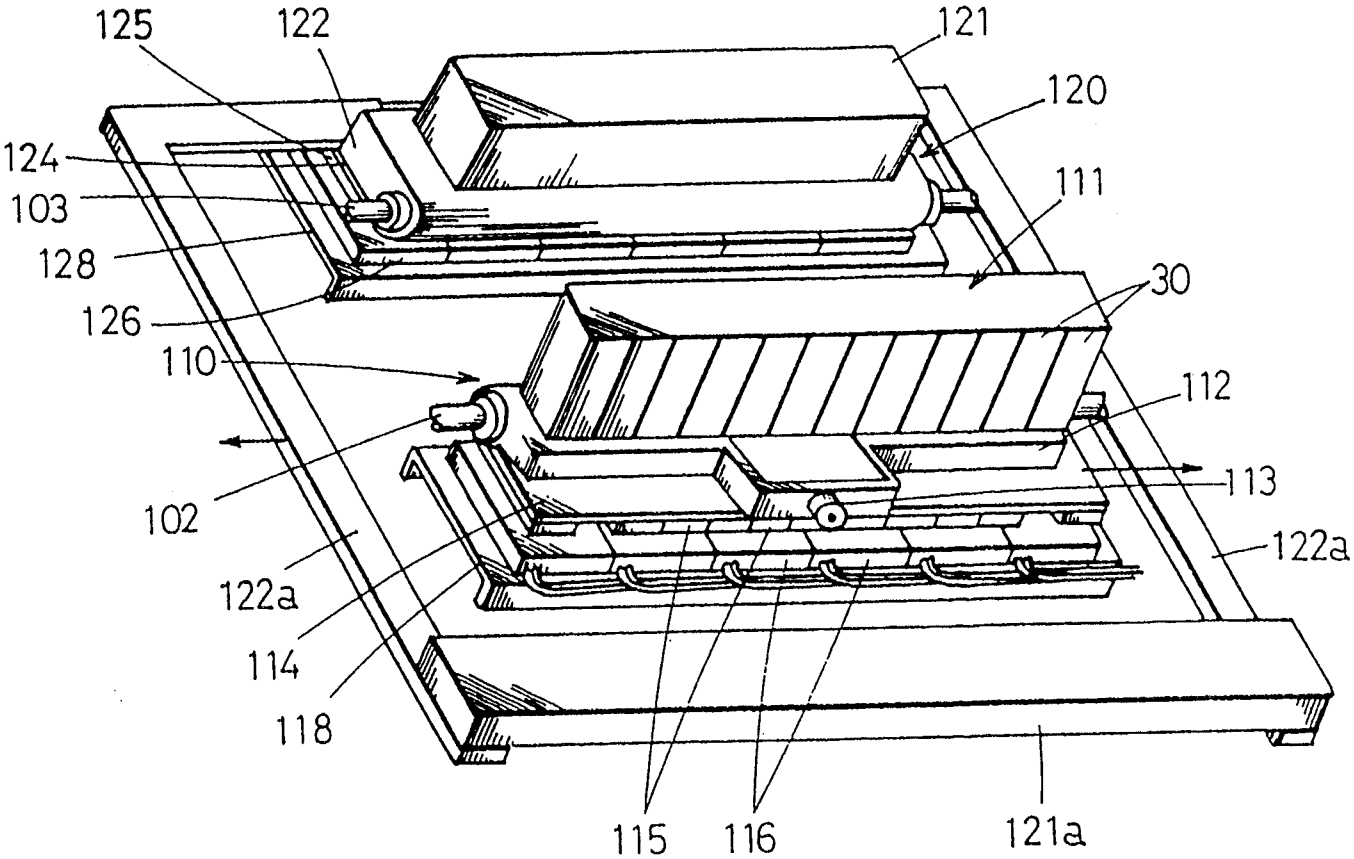
FIG. 15 is a perspective view of a line printer to which the present invention is applied.
Figure 16:
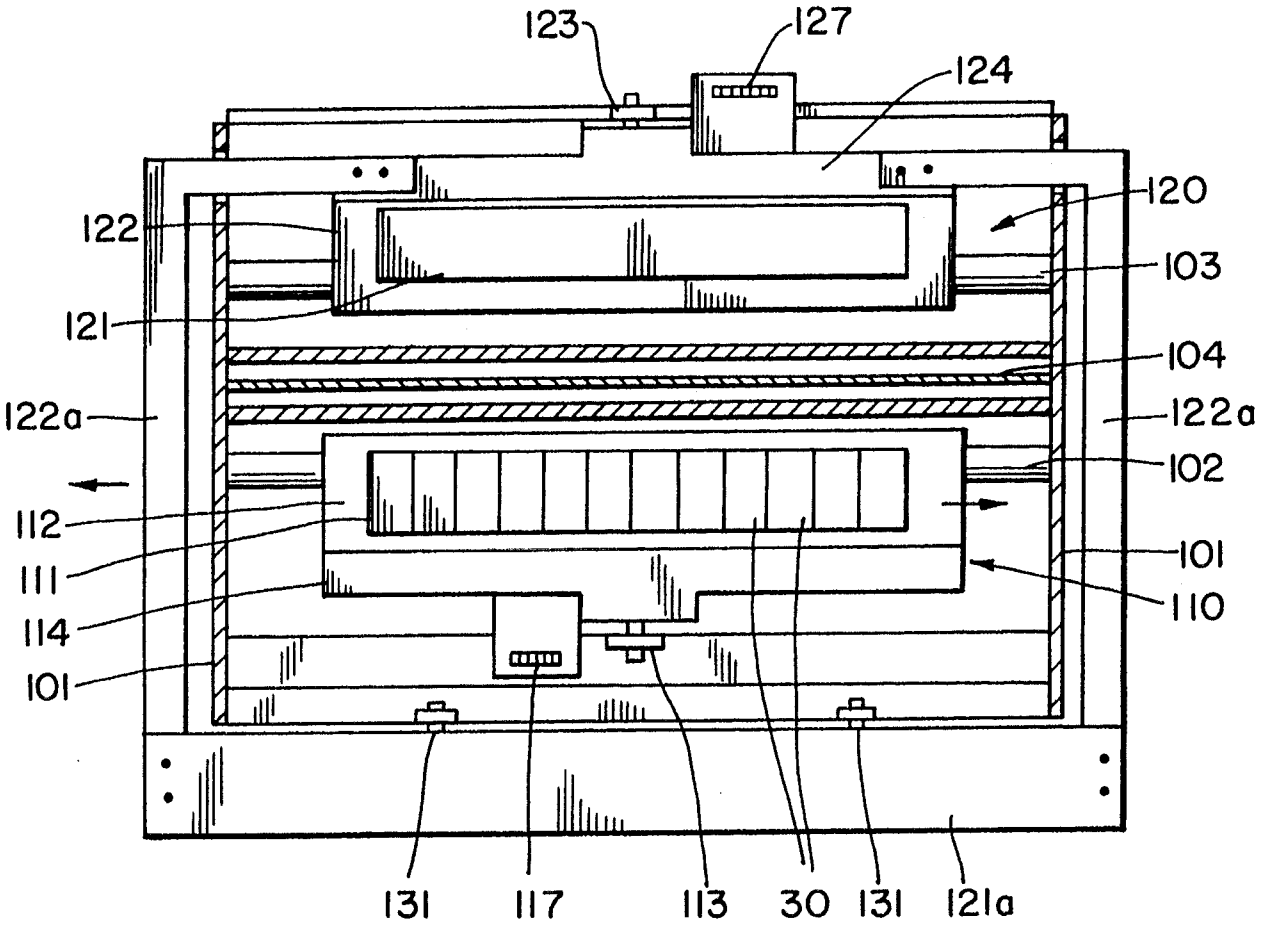
FIG. 16 is a plan view of the line printer to which the present invention is applied.
Figure 17:
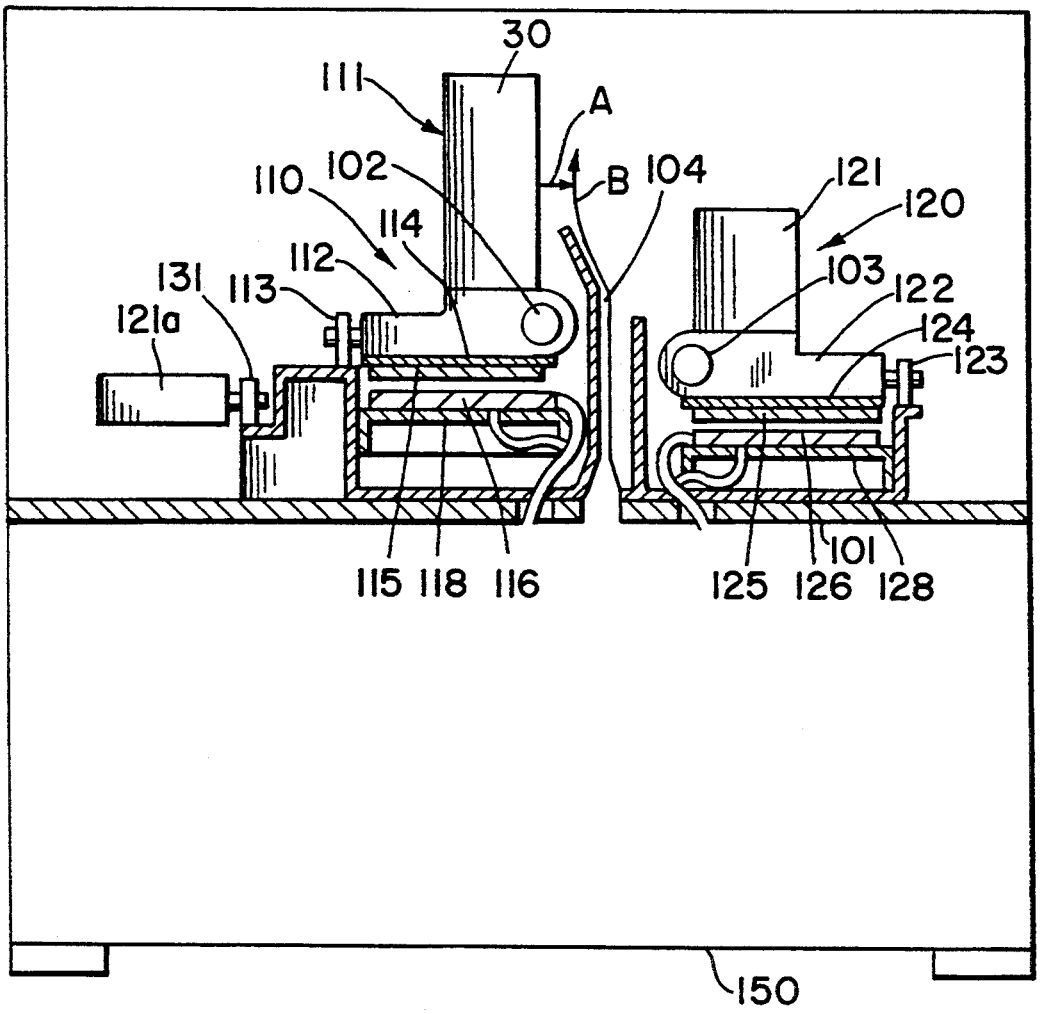
FIG. 17 is a sectional side view of the line printer to which the present invention is applied.

FIGS. 15 to 20 show in combination one embodiment in which the print head of the present invention is applied to a line printer. FIGS. 15, 16 and 17 are perspective, plan and sectional side views, respectively.

A base frame 101 is secured to a casing 150 as shown in FIG. 17. A pair of parallel stay shafts 102 and 103 extend horizontally and are each secured at both ends thereof to the base frame 101. It should be noted that in FIG. 15 illustration of the base frame 101 is omitted, and in FIGS. 15 and 16 illustration of the casing 150 is omitted.

A print shuttle 112 is slidably fitted on the first stay shaft 102, which is disposed in the central portion of the base frame 101. The print shuttle 112 is equipped with a print head 111 comprising a row of a multiplicity of print wires. The print shuttle 112 is supported by the first stay shaft 102 and a roller 113 capable of traveling on the base frame 101.

The print head 111 is of an electromagnetic release type print head to which the present invention is applied. That is, the print head 111 is provided with an intermediate guide for suppressing secondary natural vibration of the print wires. The print head 111 comprises a row of 12 (for example) print head assemblies 30 of 24-dot type arranged horizontally. Each print head assembly 30 is formed from 4 sets of 6 print elements which are respectively arranged in front upper, front lower, rear upper and rear lower stages in such a manner that the two sets of print elements in the front and rear upper stages are symmetric with respect to those in the front and rear lower stages. The print elements perform printing in units of dots by print wires.

When the print head 111 is driven, the distal ends of the print wires project in the direction of the arrow A, shown in FIG. 17, thereby striking printing paper, which is fed in the direction of the arrow B through a paper feed passage 104, through an ink ribbon (not shown). Thus, impact dot printing is carried out.

A yoke 114, which is a planar iron plate, is attached to the bottom of the print shuttle 112. A row of a multiplicity of rectangular plate-shaped permanent magnets 115 are disposed on the lower surface of the yoke 114 in a direction parallel to the axis of the first stay shaft 102. The permanent magnets 115 are each magnetized in the direction of the thickness thereof. That is, each permanent magnet 115 has two magnetic poles at the upper and lower end faces thereof.

The permanent magnets 115 are formed by using rare-earth magnets, which have a strong magnetic property, for example, samarium-cobalt magnets. Accordingly, the permanent magnets 115 are thin and light in weight in comparison to ferrite magnets or others (e.g., the thickness and weight are each 1/5 of that in the case of the latter).

Figure 18:
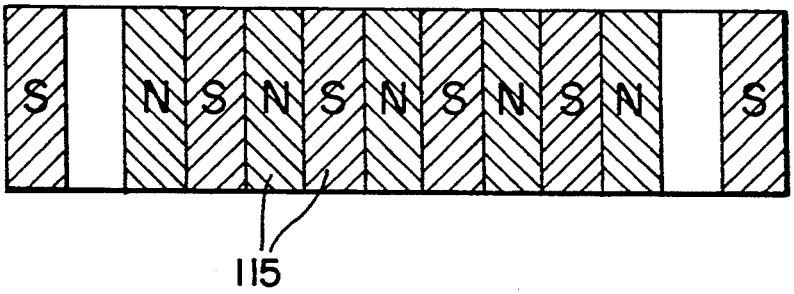
FIG. 18 is a plan view of permanent magnets in, the line printer to which the present invention is applied.

Each permanent magnet 115 has a slightly larger width than that of each print head assembly 30. As shown in FIG. 18, a series of 11 permanent magnets 115 are disposed so that N and S poles alternate with each other. Among the 11 permanent magnets 15, a row of 9 permanent magnets are disposed contiguously, and one permanent magnet is disposed at each end of the row of permanent magnets with a spacing provided between the same and the end of the row.

Thus, the print shuttle 112, and the print head 111, the yoke 114 and the permanent magnets 115, which are attached to the print shuttle 112, form a print shuttle unit 110 which is movable along the first stay shaft 102.

A row of electromagnetic coils 116 are secured to a coil base 118, which is formed from an iron plate secured to the base frame 101, so that the electromagnetic coils 116 face the permanent magnets 115 of the print shuttle unit 110 across a slight gap. Thus, the permanent magnets 115 and the electromagnetic coils 116 form a linear motor (first linear motor) for driving the print shuttle unit 110.

Figure 19:
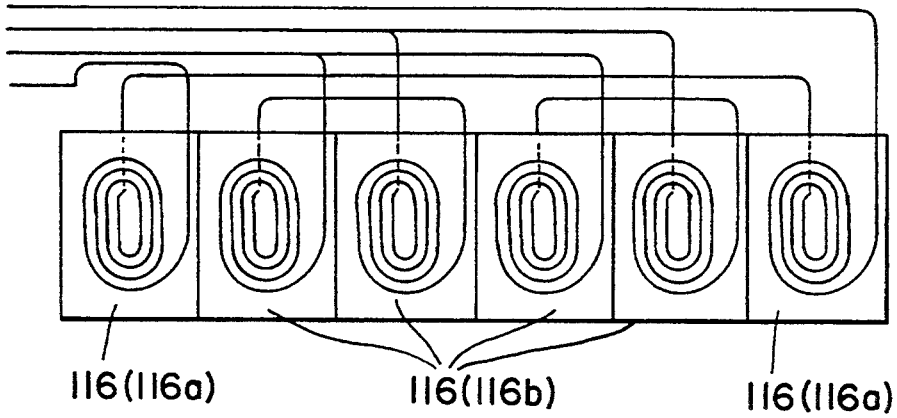
FIG. 19 is a plan view of electromagnetic coils in the line printer to which the present invention is applied.

Each electromagnetic coil 116 is spirally coiled so as to have a width double that of each permanent magnet 115. As schematically shown in FIG. 19, a row of 6 electromagnetic coils 116 are disposed contiguously. It should be noted that the outer edges of each pair of adjacent electromagnetic coils 116 are in contact with each other, although they are schematically shown as being separate from each other in FIG. 19.

Among the 6 electromagnetic coils 116, two electromagnetic coils **116*a* which are disposed at both ends, respectively, of the row of electromagnetic coils 116 are used to reverse the operation of the first linear motor. These electromagnetic coils 116*a* are connected in series to the same lead wires. On the other hand, the four electromagnetic coils 116*b*, which are disposed in between the electromagnetic coils 116*a*, are used to drive the first linear motor at a constant speed. These electromagnetic coils 116*b* are connected in series to lead wires in pairs, which are different from those for the end electromagnetic coils 116*a***.

In the first linear motor, arranged as described above, as current is passed through the electromagnetic coils 116, which are placed in the magnetic fields produced by the permanent magnets 115, thrust is induced in the electromagnetic coils 116 on the basis of the Fleming's left-hand rule.

However, since the electromagnetic coils 116 are immovably fixed to the base frame 101, the reaction force to the thrust acts on the permanent magnets 115. As a result, the print shuttle unit 110 moves along the first stay shaft 102.

By properly controlling the current supplied to the electromagnetic coils 116, the print shuttle unit 110 can be rectilinearly reciprocated at high speed along the first stay shaft 102.

In addition, a position detecting sensor 117 is provided, as shown in FIG. 16. The position detecting sensor 117 comprises slits formed in the yoke 114 of the print shuttle unit 110, and a transmissive photosensor that is attached to the base frame 101. In FIG. 15, however, illustration of the position detecting sensor 117 is omitted.

A balance shuttle 122, which is formed in the same way as the print shuttle 112, is slidably fitted on the second stay shaft 103, which is disposed parallel to the first stay shaft 102.

A counterweight 121 is mounted on the balance shuttle 122, and a yoke 124 is attached to the bottom of the balance shuttle 122. A row of permanent magnets 125, which are similar to the permanent magnets 115 of the print shuttle unit 110, are attached to the lower surface of the yoke 124.

A roller 123 is rotatably attached to the balance shuttle 122 so that the balance shuttle 122 travels on the base frame 101. The balance shuttle 122 is supported by the roller 123 and the second stay shaft 103.

The balance shuttle 122 further has a pair of arms **122*a* which are connected thereto so as to project from both lateral ends, respectively, of the base frame 101. The arms 122*a* are bent to extend beyond the position of the print shuttle unit 110 as far as the other end of the base frame 101, and a counterweight unit 121*a* is attached to the distal ends of the arms 122*a***.

Thus, a balance shuttle unit 120 is formed from the balance shuttle 122 and the counterweight 121, the yoke 124, the permanent magnets 125 and the arms **122*a*, which are attached to the balance shuttle 122, together with the counterweight: unit 121*a* attached to the distal ends of the arms 122*a***.

The constituent elements of the balance shuttle unit 120 can move as one unit in parallel to the print shuttle unit 110. Rollers 131 are rotatably attached to the counterweight unit **121*a* so that the counterweight unit 121*a* travels on the base frame 101**.

The balance shuttle unit 120 is formed so that the overall weight thereof is approximately equal to that of the print shuttle unit 110. Distribution of weight in the balance shuttle unit 120 is made so that the line of travel of the center of gravity of the whole balance shuttle unit, 120 during the movement along the second stay shaft 103 is approximately coincident with the line of travel of the center of gravity of the print shuttle unit 110 during the movement along the first stay shaft 102.

Referring back to FIGS. 15 to 17, a coil base 128 is secured to the base frame 101, and a row of electromagnetic coils 126, which are similar to the electromagnetic coils 116 shown in FIG. 19, are secured to the coil base 128 so as to face the row of permanent magnets 125 disposed on the balance shuttle 122 across a slight gap. Thus, the permanent magnets 125 and the electromagnetic coils 126 form a linear motor (second linear motor) for driving the balance shuttle unit 120.

By properly controlling the current passed through the electromagnetic coils 126, the balance shuttle unit 120 can be rectilinearly reciprocated at high speed along the second stay shaft 103.

Figure 20:
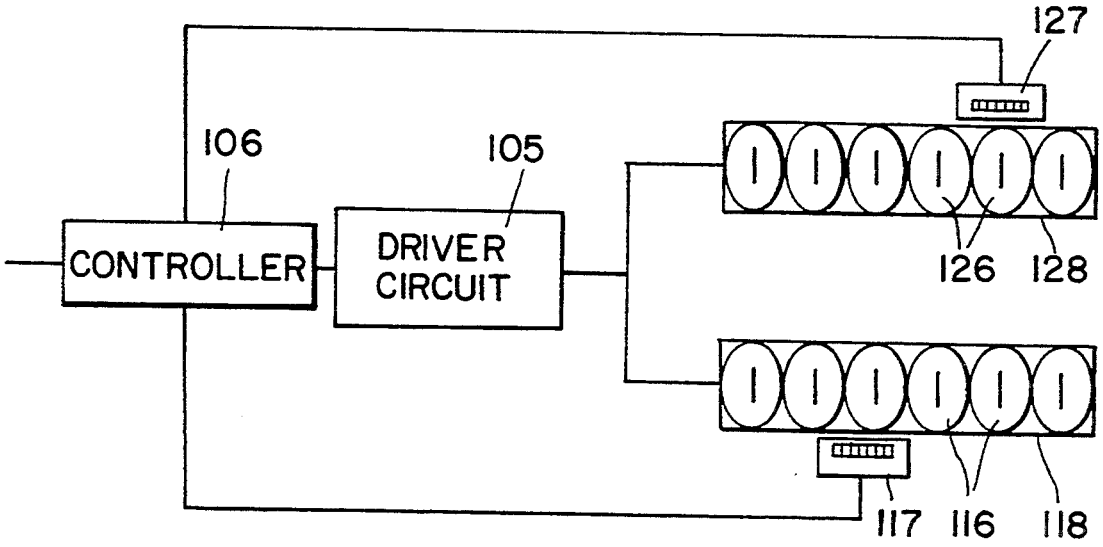
FIG. 20 schematically shows a circuit configuration of the line printer to which the present invention is applied.
Figure 21A:
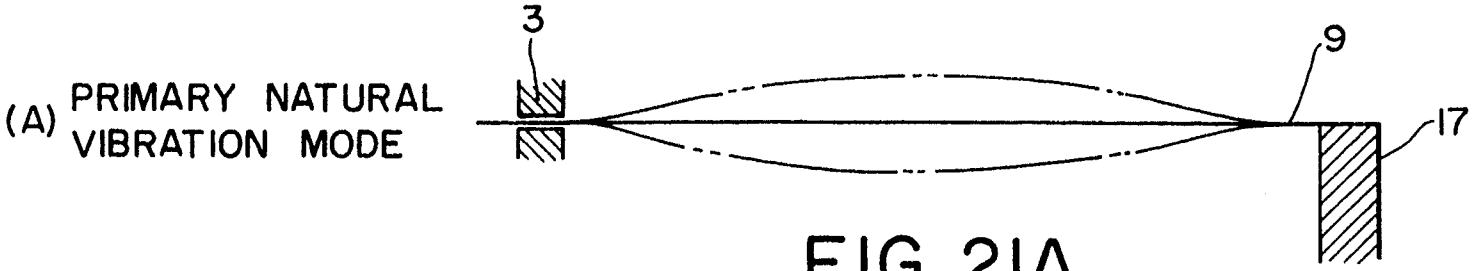
FIG. 21 shows two different kinds of vibration of a print wire and stress characteristics.
Figure 21B:
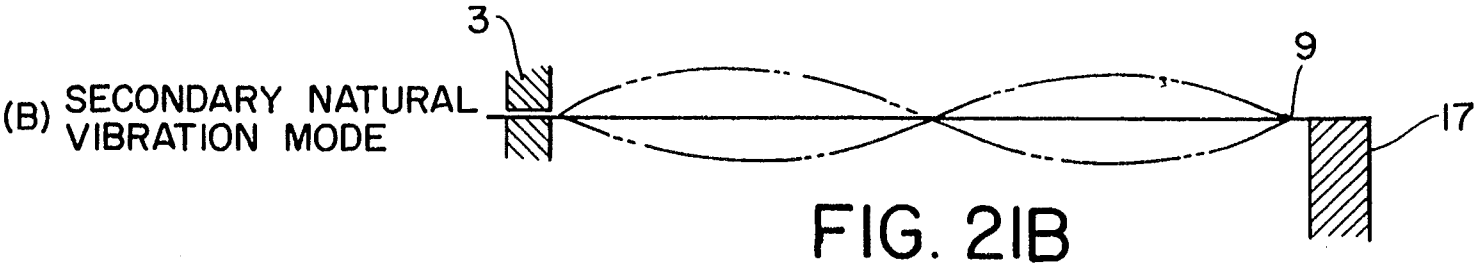
Figure 21C:
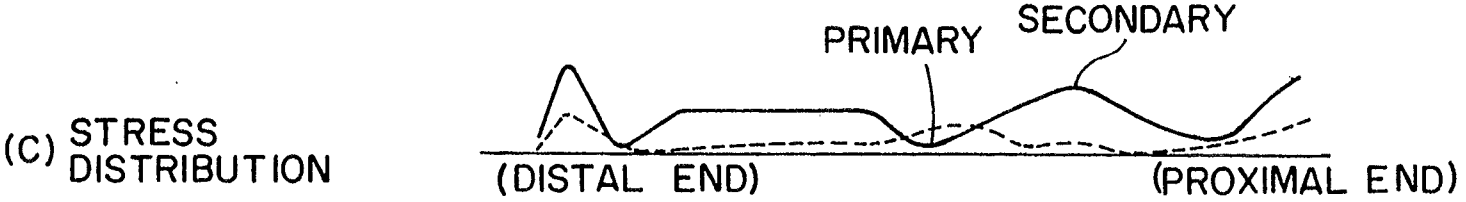

FIG. 20 schematically shows a circuit configuration for the first and second linear motors. The electromagnetic coils 116 and 126 are supplied with the same driving current from a single driver circuit 105 so that the print shuttle unit 110 and the balance shuttle unit 120 move relative to each other in opposite directions at the same speed to perform high-speed reciprocating motion.

For this purpose, the print shuttle unit 110 and the balance shuttle unit 120 are arranged in reverse relation to each other in terms of either the polarities of the permanent magnets 115 and 125 or the winding direction of the electromagnetic coils 116 and 126.

A controller 106 for controlling the operation of the driver circuit 105 is fed with signals for reversing and constant-speed travel from the position detecting sensor 117 of the print shuttle unit 110 to effect feedback control for the reciprocating motion.

The controller 106 is further fed with a signal from a position detecting sensor 127 provided on the balance shuttle unit 120 to monitor for the occurrence of overrun or other trouble of the balance shuttle unit 120.

In the printer shuttle apparatus, arranged as described above, as the print shuttle unit 110 reciprocates along the first stay shaft 102, the balance shuttle unit 120, which is approximately equal in weight to the print shuttle unit 110, moves along the second stay shaft 103 in a direction reverse to the direction of travel of the print shuttle unit 110 at the same speed as that of the print shuttle unit 110 in linked relation to it.

Accordingly, reaction force that is induced in the base frame 101 by the reciprocating motion of the print shuttle unit 110 is canceled by the reciprocating motion of the balance shuttle unit 120.

In addition, during the reciprocating motion, the center of gravity of the balance shuttle unit 120 moves on a line approximately the same as the travel line of the center of gravity of the print shuttle unit 110. Accordingly, no rotation moment is induced by the reciprocating motions of the two shuttle units 110 and 120.

According to the present invention, an intermediate guide for preventing diametrical oscillation of print wires is provided in the vicinity of an antinode in the secondary natural vibration mode of the print wires, thereby suppressing the secondary natural vibration of the print wires. Accordingly, the bending stress that is generated in the print wires at the distal end portions guided by the distal end guide decreases by a large margin. Thus, breakage of the print wires is prevented, and the durability of the print wires improves markedly.

If the intermediate guide is formed from a pair of thin plate members spaced apart from each other and a connecting member which connects together these plate members as one unit, deformation, e.g., warpage, decreases. If the intermediate guide is further arranged such that each print wire contacts one surface of the connecting member, the contact pressure of the print wires with respect to the intermediate guide decreases. Therefore, the wear of the guide holes is minimized. Thus, the intermediate guide is also improved in durability.

If the intermediate guide is supported with some play by L-shaped projections projected from a frame, the production is facilitated, and the production cost lowers. Even if the intermediate guide has some warp, wear of the intermediate guide can be minimized.

While the invention has been described by reference to specific embodiments chosen for purposes of illustration, it should be apparent that numerous modifications could be made thereto by those skilled in the art without departing from the basic concept and scope of the invention.

What is claimed is:

1. A wire dot print head having long thin print wires capable of advancing and withdrawing in a direction of a longitudinal axis of each respective one of said print wires with respect to a print surface, and wire driving means connected to the proximal end of each of said print wires so as to drive each said print wire to advance and withdraw in said direction, said wire dot print head comprising:

a distal end guide for guiding distal end portions of said print wires so as to prevent them from shifting diametrically; and an intermediate guide aligned with said end guide and positioned for guiding portions of said print wires which are at an antinode in a secondary natural vibration mode of said print wires so as to suppress generating of secondary natural vibration of said print wires to prevent said print wires from oscillating diametrically.

2. A wire dot print head according to claim 1, wherein said intermediate guide is disposed at either a first antinode or a second antinode in a secondary natural vibration mode of said print wires.

3. A wire dot print head according to claim 1, wherein said intermediate guide is disposed at each of first and second antinodes in a secondary natural vibration mode of said print wires.

4. A wire dot print head according to claim 1, wherein said intermediate guide comprises a pair of thin plate members spaced in said direction and each provided with guide holes through which said print wires are loosely passed.

5. A wire dot print head according to claim 4, wherein said pair of thin plate members are connected together as one unit by a connecting member disposed where said guide holes are not covered thereby.

6. A wire dot print head according to claim 5, wherein said connecting member is formed along an area between said guide holes of said pair of plate members so that said print wires each contact one surface of said connecting member.

7. A wire dot print head according to claim 1, wherein said intermediate guide is formed in a thin plate-shaped configuration and supported with some play by a plurality of L-shaped projections projected from a frame of said print head.

8. A wire dot print head according to claim 7, wherein said intermediate guide comprises two thin plate members spaced from each other in said direction.

9. A wire dot print head according to claim 7, wherein said intermediate guide comprises a single thin plate member.

10. A wire dot print head according to claim 1, which is used in a line printer wherein a plurality of said wire dot print heads are disposed in a horizontal row.

11. A wire dot print head according to claim 10, wherein said wire dot print heads are mounted on a print shuttle capable of reciprocating.

12. A wire dot print head according to claim 11, wherein said print shuttle is driven to reciprocate by a linear motor.

13. A wire dot print head having long thin print wires capable of advancing and withdrawing in a direction of longitudinal axis of said print wires with respect to a print surface, and wire driving means connected to the proximal end of each of said print wires so as to drive each of said print wires to advance and withdraw axially, said wire dot print head comprising:

a distal end guide for guiding distal end portions of said print wires so as to prevent them from shifting diametrically; and an intermediate guide positioned for guiding portions of said print wires which are at least at one antinode in a secondary natural vibration mode of said print wires so as to suppress generating a secondary natural vibration of said print wires to prevent said print wires from oscillating diametrically such that each of said print wires is disposed in a straight state between a proximal end and a distal end thereof.

* * * * *